US009726131B2

(12) United States Patent
Hashii et al.

(10) Patent No.: US 9,726,131 B2
(45) Date of Patent: Aug. 8, 2017

(54) FUEL INJECTION VALVE

(75) Inventors: Naoya Hashii, Chiyoda-ku (JP); Keishi Nakano, Chiyoda-ku (JP); Tsuyoshi Munezane, Chiyoda-ku (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 164 days.

(21) Appl. No.: 12/444,780

(22) PCT Filed: Jan. 29, 2007

(86) PCT No.: PCT/JP2007/051378

§ 371 (c)(1),
(2), (4) Date: Apr. 8, 2009

(87) PCT Pub. No.: WO2008/093387

PCT Pub. Date: Aug. 7, 2008

(65) Prior Publication Data

US 2010/0090031 A1 Apr. 15, 2010

(51) Int. Cl.
*F02M 61/18* (2006.01)
*F02M 51/06* (2006.01)

(52) U.S. Cl.
CPC .... *F02M 61/1853* (2013.01); *F02M 51/0675* (2013.01); *F02M 51/0678* (2013.01);
(Continued)

(58) Field of Classification Search
CPC ..... F02M 61/18; F02M 61/1813; F02M 61/1853; F02M 61/1873; F02M 61/1866;
(Continued)

(56) References Cited

U.S. PATENT DOCUMENTS 1,693,931 A * 12/1928 Lowe ..... 123/297
2,563,152 A * 8/1951 Brandt ..... 239/596
(Continued)

FOREIGN PATENT DOCUMENTS

DE WO2005000524 * 1/2005
JP 3-242459 A 10/1991
(Continued)

OTHER PUBLICATIONS

Indian Office Action issued Aug. 26, 2014 in Counterpart Patent Application No. 2827/CHENP/2009.

*Primary Examiner* — Arthur O Hall
*Assistant Examiner* — Steven M Cernoch
(74) *Attorney, Agent, or Firm* — Sughrue Mion, PLLC; Richard C. Turner

(57) ABSTRACT

A fuel injection valve in which a valve element is formed at a distal end thereof with a flat portion 13*c* which is substantially parallel with an injection hole plate 11, injection hole entrances 12*a* are arranged inside an imaginary envelop 15 along an intersection between an extension 10*b* of a downstream inner wall of a seat portion of a valve seat and an upstream plane 11*c* of the injection hole plate and outside the flat plane at the distal end of the valve element, and the relation between the vertical distance h between the flat plane at the distal end of the valve element and the upstream plane of the injection hole plate with the valve opened and the diameter d of the injection hole entrance is h<d, and the injection hole 12 is formed to be inclined by a predetermined angle with respect to the direction of the thickness of the injection hole plate.

7 Claims, 8 Drawing Sheets

(52) U.S. Cl.
CPC ..... *F02M 61/18* (2013.01); *F02M 61/188* (2013.01); *F02M 61/1813* (2013.01); *F02M 61/1866* (2013.01); *F02M 61/1873* (2013.01)

(58) Field of Classification Search
CPC ..... F02M 61/188; F02M 51/0675; F02M 51/0678
USPC ..... 239/533.12, 569, 584, 585.1, 583, 596, 239/533.2, 533.3, 585.4, 585.5, 518, 524, 239/533.11, 533.4, 533.5, 533.6, 533.7, 239/533.8, 533.9, 556, 557, 558, 585.2, 239/585.3, 586, 601
See application file for complete search history.

(56) References Cited

U.S. PATENT DOCUMENTS

| | | | | |
|---|---|---|---|---|
| 4,621,772 | A * | 11/1986 | Blythe et al. | 239/585.4 |
| 4,732,327 | A * | 3/1988 | Aichele et al. | 239/463 |
| 5,002,231 | A * | 3/1991 | Reiter et al. | 239/585.1 |
| 5,344,081 | A * | 9/1994 | Wakeman | 239/585.4 |
| 5,370,317 | A * | 12/1994 | Weston | 239/533.14 |
| 5,370,318 | A * | 12/1994 | Weston | 239/533.14 |
| 5,383,607 | A * | 1/1995 | Heyse et al. | 239/585.4 |
| 5,484,108 | A * | 1/1996 | Nally | 239/553.3 |
| 5,746,376 | A * | 5/1998 | Romann et al. | 239/585.4 |
| 5,762,272 | A * | 6/1998 | Tani et al. | 239/543 |
| 5,772,124 | A * | 6/1998 | Tamaki et al. | 239/533.12 |
| 5,862,991 | A * | 1/1999 | Willke et al. | 239/397.5 |
| 5,931,391 | A | 8/1999 | Tani et al. | |
| 6,070,812 | A * | 6/2000 | Tani et al. | 239/533.12 |
| 6,330,981 | B1 * | 12/2001 | Nally et al. | 239/533.12 |
| 6,360,960 | B1 * | 3/2002 | Nally et al. | 239/5 |
| 6,439,484 | B2 * | 8/2002 | Harata et al. | 239/596 |
| 6,502,761 | B1 * | 1/2003 | Pace et al. | 239/5 |
| 6,719,223 | B2 * | 4/2004 | Yukinawa et al. | 239/584 |
| 6,729,563 | B2 * | 5/2004 | Peterson, Jr. | 239/533.12 |
| 6,742,727 | B1 * | 6/2004 | Peterson, Jr. | 239/533.3 |
| 6,764,031 | B2 * | 7/2004 | Sebastian et al. | 239/584 |
| 6,779,743 | B2 * | 8/2004 | Kitamura | 239/533.12 |
| 6,786,423 | B2 * | 9/2004 | Peterson, Jr. | 239/5 |
| 6,837,449 | B2 * | 1/2005 | Dantes et al. | 239/533.12 |
| 6,921,022 | B2 * | 7/2005 | Nally et al. | 239/5 |
| 7,048,202 | B2 * | 5/2006 | Bierstaker et al. | 239/5 |
| 7,093,776 | B2 * | 8/2006 | Schneider | 239/533.12 |
| 7,150,417 | B2 * | 12/2006 | Souma | 239/585.1 |
| 7,364,099 | B2 * | 4/2008 | Boecking | 239/533.12 |
| 7,434,752 | B2 * | 10/2008 | Matsumoto et al. | 239/585.4 |
| 7,611,125 | B2 * | 11/2009 | Ott | 251/359 |
| 7,980,485 | B2 * | 7/2011 | Peterson, Jr. | 239/5 |
| 8,002,207 | B2 * | 8/2011 | Hashii et al. | 239/596 |
| 8,083,160 | B2 * | 12/2011 | Kato et al. | 239/533.12 |
| 8,096,490 | B2 * | 1/2012 | Yasukawa et al. | 239/533.12 |
| 8,302,889 | B2 * | 11/2012 | Hashii et al. | 239/596 |
| 2001/0017325 | A1 * | 8/2001 | Harata et al. | 239/533.12 |
| 2003/0047623 | A1 * | 3/2003 | Dantes | 239/533.12 |
| 2005/0205693 | A1 * | 9/2005 | Teschner et al. | 239/533.2 |
| 2005/0284965 | A1 * | 12/2005 | Schneider | 239/533.12 |
| 2006/0065763 | A1 * | 3/2006 | Akabane | 239/533.2 |

FOREIGN PATENT DOCUMENTS

| | | | |
|---|---|---|---|
| JP | 11-70347 | A | 3/1999 |
| JP | 3183156 | B2 | 4/2001 |
| JP | 2002-21686 | A | 1/2002 |
| JP | 2002-332935 | A | 11/2002 |
| JP | 2002332935 | A | 11/2002 |

* cited by examiner

X-X CROSS SECTION

A-A CROSS SECTION

B-B CROSS SECTION

Y-Y CROSS SECTION

Z-Z CROSS SECTION

FUEL INJECTION VALVE

TECHNICAL FIELD

The present invention relates to a fuel injection valve used in an engine and, more specifically, to a fuel injection valve in which atomization of fuel spray is improved while restraining excessive spray diffusion.

BACKGROUND ART

Recently, improvement of flexibility of direction of fuel spray injection injected from a fuel injection valve and atomization of fuel spray is required in a circumstance in which exhaust gas regulation for automotive vehicles or the like is tightened. In particular, atomization of fuel spray has been studied in various manner, and, for example, disclosed in Patent Publication No. 3183156 (hereinafter, referred to as Patent Document 1) is a fluid injection nozzle in which injection holes are arranged inside an imaginary envelope along an intersection between the main flow direction of fluid on the downstream side of a seat portion of a valve seat and an injection hole plate, a portion of the distal end of a valve element, which is located inwardly of the seat portion and opposes the injection holes is formed into a flat plane parallel to the injection hole plate, the injection holes are inclined with respect to the injection hole plate by a predetermined angle and satisfy a relation $h<1.5d$ where d represents the diameter of the injection hole, and h represents the vertical distance between the flat plane of the valve element and the injection hole plate with the valve opened.

According to this injection nozzle, after fuel is flowed out from the seat portion of the valve seat, the flow is converted to a flow along the injection hole plate in a cavity interposed between the flat plane of the valve element and the injection hole plate, and a flow proceeding directly to the injection holes and a flow passing between the injection holes, making a U-turn at the center of the injection hole plate by the opposing flow and proceeding to the injection holes are generated, whereby flows which proceed uniformly toward the injection holes may be obtained. Accordingly, collision between the fuel flows may be induced immediately above the injection holes, whereby atomization is accelerated.

Patent Document 1: Japanese Patent No. 3183156

DISCLOSURE OF INVENTION

Problems to be Solved by the Invention

In the technology disclosed in Patent Document 1, conversion of the flow of fuel flowed out from the seat portion of the valve seat into the flow parallel to the injection hole plate in the cavity interposed between the flat plane of the valve element and the injection hole plate is used for atomization of fuel spray. However, the flow rate of the fuel entering into the injection holes is subjected to variation in height of the cavity. Therefore, since the height of the cavity defined in Patent Document 1 is affected by variation in machining or the inclination of the valve element with the valve opened, it has a disadvantage such that flow rate accuracy or spray characteristic tend to vary from one fuel injection valve to another.

Means to cause the flow toward the center of the injection hole plate and the flow passing between the injection holes, making the U-turn at the center of the injection hole plate by the opposing flow and proceeding to the injection holes to collide with each other immediately above the injection holes is effective for atomization. However, the spray tends to diffuse easily, and hence directivity of spray is deteriorated. Therefore, the spray adheres to the wall surface of an inlet port, and enters a combustion chamber in the form of a liquid film, whereby there is a possibility to cause degradation of exhaust gas or degradation of controllability of engine output.

In order to solve the above-described problems, in the device in the related art, it is an object of the present invention to provide a fuel injection valve for a gasoline engine in which atomization of fuel spray is improved while restraining variation in flow rate accuracy or spray characteristic, and maintaining the directivity of spray.

Best Mode For Carrying Out the Invention

A fuel injection valve according to the present invention including a valve element for opening and closing a valve seat and the valve element being driven upon reception of an operation signal from a control unit and causing fuel to be injected from a plurality of injection holes formed on an injection hole plate mounted on the downstream side of the valve seat, wherein the valve element is formed at a distal end thereof with a flat plane which is substantially parallel with the injection hole plate, wherein injection hole entrances of the injection holes are arranged inside an imaginary envelop along an intersection between an extension of a downstream inner wall of a seat portion of the valve seat and an upstream plane of the injection hole plate, and outside the flat plane at the distal end of the valve element, and wherein the relation between the vertical distance h between the flat plane at the distal end of the valve element and the upstream plane of the injection hole plate with the valve opened and the diameter d of the injection hole entrance is $h<d$, and the injection hole is formed to be inclined by a predetermined angle with respect to the direction of the thickness of the injection hole plate.

A fuel injection valve according to the present invention including a valve element for opening and closing a valve seat and the valve element being driven upon reception of an operation signal from a control unit and causing fuel to be injected from a plurality of injection holes formed on an injection hole plate mounted on the downstream side of the valve seat, wherein a projection which projects toward the downstream so as to extend substantially in parallel with the distal end of the valve element is formed at the center of the injection hole plate, and a flat portion is formed out side of the projection, wherein the relation between the minimum distance r from the distal end of the valve element to the center of the injection hole plate with the valve opened and the diameter d of the injection hole entrance is $r<d$, and wherein injection hole entrances of the injection holes are arranged inside the minimum inner diameter of the valve seat on the flat portion.

Advantage of the Invention

According to the fuel injection valve of the present invention, the injection hole entrances are arranged inside the main stream of fuel flow from the seat portion of the valve seat, and the surface area of the cavity flow path immediately above the injection holes suddenly reduces. Therefore, the fuel flow entering the injection hole entrances at a large angle is enhanced, and hence the atomized fuel spray is obtained while restraining excessive spray diffusion.

Since one surface of the flow path immediately above the injection holes in the cavity is configured by a high-accuracy ball, the dimensional variation of the flow path immediately above the injection holes is small, and uneven height of the cavity due to inclination of the valve element when the valve is opened may be prevented. Therefore, variation in flow rate in the cavity immediately above the injection holes is small, and variations inflow rate accuracy (static flow rate) and spray characteristics (spray shape, diameter of spray particle) are restrained.

The above-described and other objects, characteristics and advantages of the present invention will be apparent from the detailed description and drawings in the following embodiments.

BEST MODE FOR CARRYING OUT THE INVENTION

First Embodiment

Figure 1:
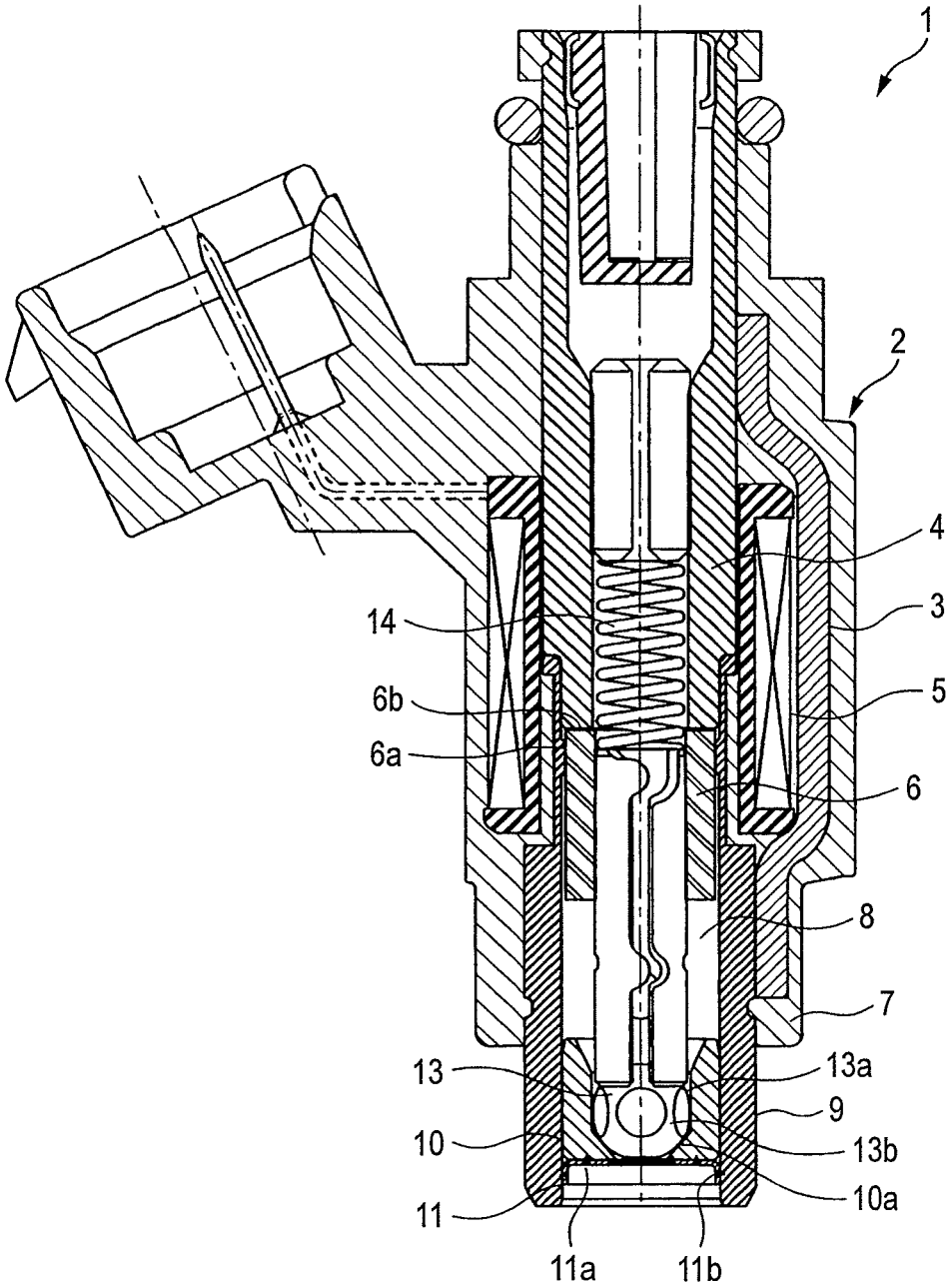
FIG. 1 is a cross-sectional view of a fuel injection valve according to a first embodiment of the present invention.
Figure 2A:
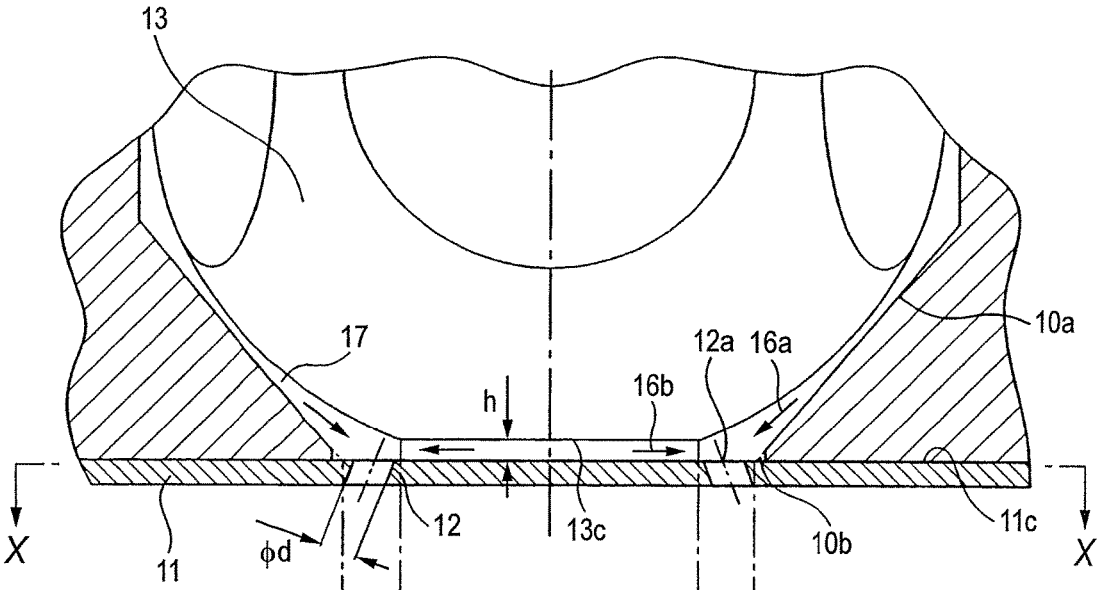
FIG. 2 is a detailed cross-section of a distal end of the fuel injection valve according to the first embodiment of the present invention.
Figure 2B:
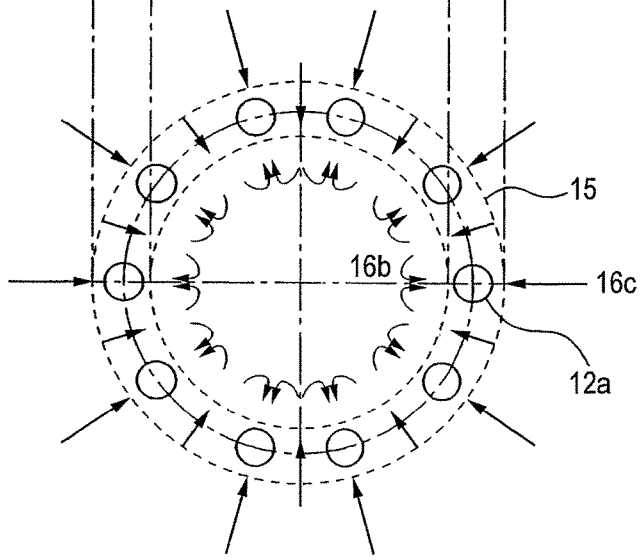

FIG. 1 is a cross-sectional view of a fuel injection valve according to a first embodiment of the present invention, and FIG. 2 is a detailed cross-section of a distal end of the fuel injection valve in the first embodiment.

In FIG. 1, reference numeral 1 designates a fuel injection valve, reference numeral 2 designates a solenoid device, reference numeral 3 designates a housing, which is a yoke portion of a magnetic circuit, reference numeral 4 designates a core, which is a fixed iron core portion of the magnetic circuit, reference numeral 5 designates a coil, reference numeral 6 designates a armature, which is a movable iron core portion of the magnetic circuit, reference numeral 7 designates a valve device, and the valve device 7 includes a valve element 8, a valve body 9 and a valve seat 10.

The valve body 9 is press-fitted into an outer diameter portion of the core 4 and is welded thereto. The armature 6 is press-fitted into the valve element 8, and is welded thereto. An injection hole plate 11 is joined to the downstream side of the valve seat 10 at a welding portion 11*a*, and then inserted into the valve element 9 and joined thereto by a welded portion 11*b*. The injection hole plate 11 is formed with a plurality of injection holes 12 therethrough in the direction of the thickness as shown in FIG. 2.

Subsequently, opening and closing movement of the fuel injection valve will be described.

When an operation signal is sent to a drive circuit of the fuel injection valve in FIG. 1 by an engine control unit, an electric current is distributed to the coil 5 of the fuel injection valve 1, so that a magnetic flux is generated in the magnetic circuit including the armature 6, the core 4, the housing 3, and the valve body 9, and the armature 6, is attracted toward the core 4. Accordingly, the valve element 8, which is integrated with the armature 6 moves away from the seat portion 10*a* of the valve seat to generate a clearance, and fuel passes from a chamfered portion 13*a* of a ball 13 welded to the distal end of the valve element 8 through the clearance between the seat portion 10*a* of the valve seat and the valve element 8 and is injected from the plurality of injection holes into an engine inlet pipe.

Subsequently, when an operation stop signal is sent to the drive circuit of the fuel injection valve from the engine control unit, distribution of the electric current in the coil 5 is stopped, and the magnetic flux in the magnetic circuit is reduced. Then, the clearance between the valve element 8 and the seat portion 10*a* of the valve seat is brought into a closed state by a compression spring 14 which urges the valve element 8 to the closing direction, whereby the fuel injection is terminated.

The valve element 8 slides with the side surface 6*a* of the armature and a guide 13*b* on the guide portion of the valve body 9, and with the valve opened, an upper surface 6*b* of the armature comes into abutment with the lower surface of the core 4. The guide 13*b* serves to regulate radial non-coaxiality (deflection) of the valve element 8 with respect to the valve seat plane, and hence it is preferable to set the clearance as small as possible. In the first embodiment, in order to keep the durable abrasion of the valve element within an allowable limit, the clearance is set to 10 μm or smaller (5 μm or smaller clearance on one side).

Figure 3A:
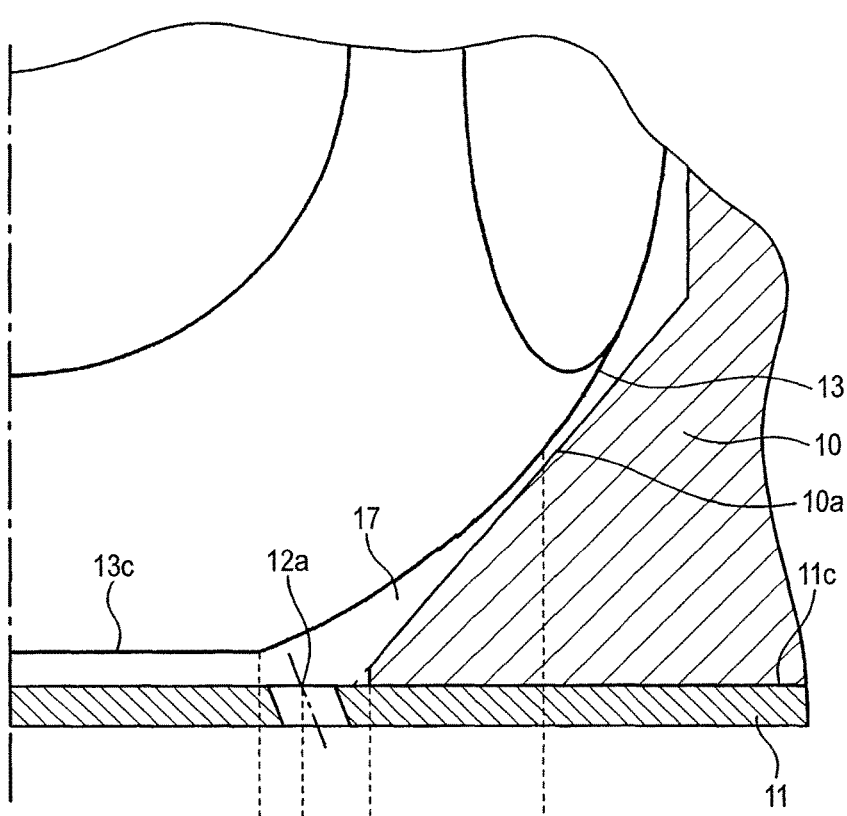
FIG. 3 is an explanatory drawing showing a change of the area of the flow path at the distal end of the fuel injection valve according to the first embodiment of the present invention.
Figure 3B:
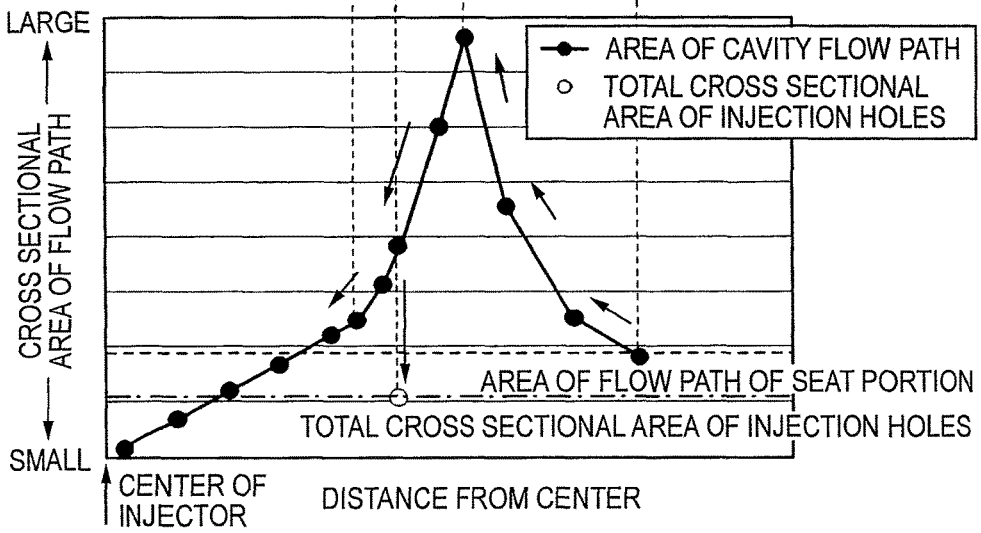
Figure 4A:
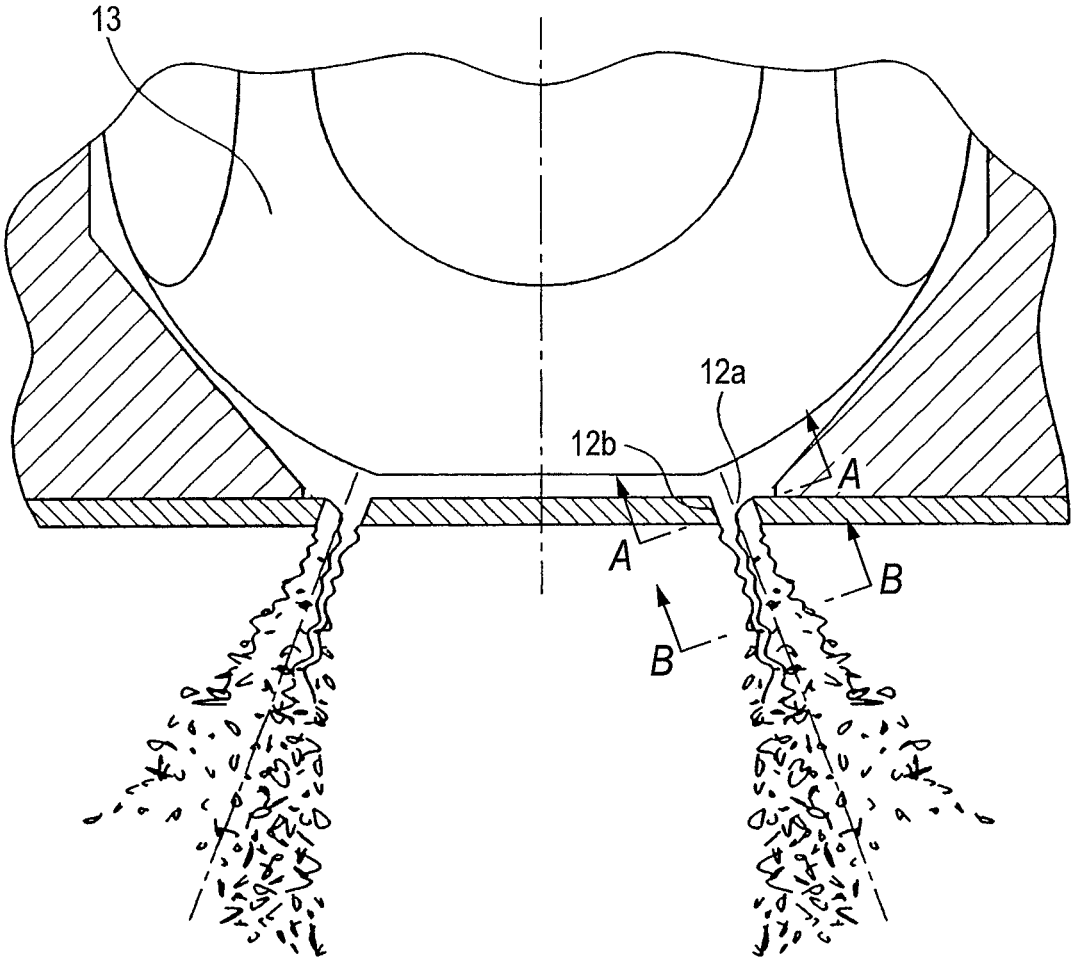
FIG. 4 is a drawing showing a state of the fuel spray injected from injection holes of the fuel injection valve according to the first embodiment of the present invention.
Figure 4B:
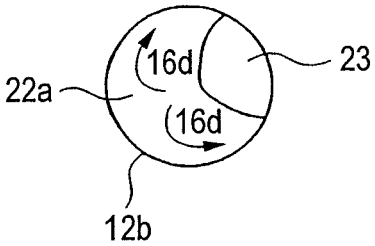
Figure 4C:
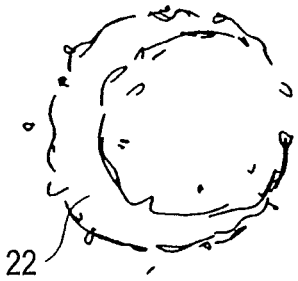

Referring now to FIG. 2 to FIG. 4, a configuration and an operation of a principal portion of the fuel injection valve according to the first embodiment of the present invention will be described.

As shown in FIG. 2, the fuel injection valve of the first embodiment includes a flat portion 13*c* which is substantially parallel with the injection hole plate 11 at the distal end of the valve element, and injection hole entrances 12*a* of the injection holes 12 are arranged on the injection hole plate at positions inside an imaginary envelop 15 along an intersection between an extension 10*b* of a downstream inner wall of the seat portion 10*a* of the valve seat and an upstream plane 11*c* of the injection hole plate and outside the flat portion 13*c* at the distal end of the valve element.

The relation between the vertical distance h between the flat portion 13*c* at the distal end of the valve element and the upstream plane of the injection hole plate with the valve opened and the diameter d of the injection hole entrance is $h<d$, and the injection hole 12 is formed to be inclined by a predetermined angle with respect to the direction of the thickness of the injection hole plate.

FIG. 3 shows a change of the area of the flow path at the distal end of the fuel injection valve.

In the fuel injection valve according to the first embodiment configured as described above, as shown in FIG. 2 and FIG. 3, a flow of fuel in a cavity 17 surrounded by the distal end 13 of the valve element and the valve seat 10 and the injection hole plate 11 is accelerated as a flow 16*a* toward the center of the imaginary envelope 15 from a moment when the fuel reaches the injection hole plate 11 to the flat portion 13*c* at the distal end of the valve element since the area of the cavity flow path suddenly reduces and, in addition, from the relation of $h<d$, the flow of the fuel from one direction into the injection holes is enhanced by restraining a flow 16*b* toward the injection holes after having passed between the injection holes and made a U-turn by an opposing flow at the center of the injection hole plate.

Therefore, as shown in FIG. 4, a liquid film 22*a* is formed by flow separation at the injection hole entrance 12*a* and the fuel is pressed against the injection hole wall 12*b*, so that the flow in the injection hole is converted into a flow 16*d* along the radius of curvature of the injection hole. Therefore, by diffusing the fuel from the injection exit as a crescent-moon-shaped liquid film 22 (FIG. 4(*c*)) while accelerating mixture with air 23 in the injection hole (FIG. 4(*b*)), atomization can be accelerated while restraining excessive spray diffusion.

Since one surface of the flow path immediately above the injection holes in the cavity 17 is configured by a ball, the dimensional variation is smaller than the flat portion 13*c* at the distal end of the valve element, and occurrence of uneven height of the cavity due to inclination of the valve element when the valve is opened may be prevented. Therefore, variation in flow rate in the cavity immediately above the injection holes is small, and variation in flow rate characteristic (static flow rate) and spray characteristics (spray shape, diameter of spray particle) are also small.

According to the fuel injection valve in the first embodiment, since the dead volume on the downstream of the seat portion of the valve seat is small, the amount of injection of initial spray injected without being accelerated at the beginning of injection and hence having a large particle diameter of the spray is small, and the amount of evaporation of fuel in the dead volume under high-temperature negative-pressure is also small. Therefore, change in flow rate characteristics (static flow rate, dynamic flow rate) and spray characteristics (shape of splay, particle diameter of the spray) in association with the change of atmosphere may be restrained.

As described thus far, according to the first embodiment of the present invention, with the spray characteristics such as good directivity of spray for aiming the induction valve and good mixing ability with air, a fuel injection valve which can provide the fuel spray with reduced exhaust emission and fuel consumption can be obtained.

Second Embodiment

Figure 5A:
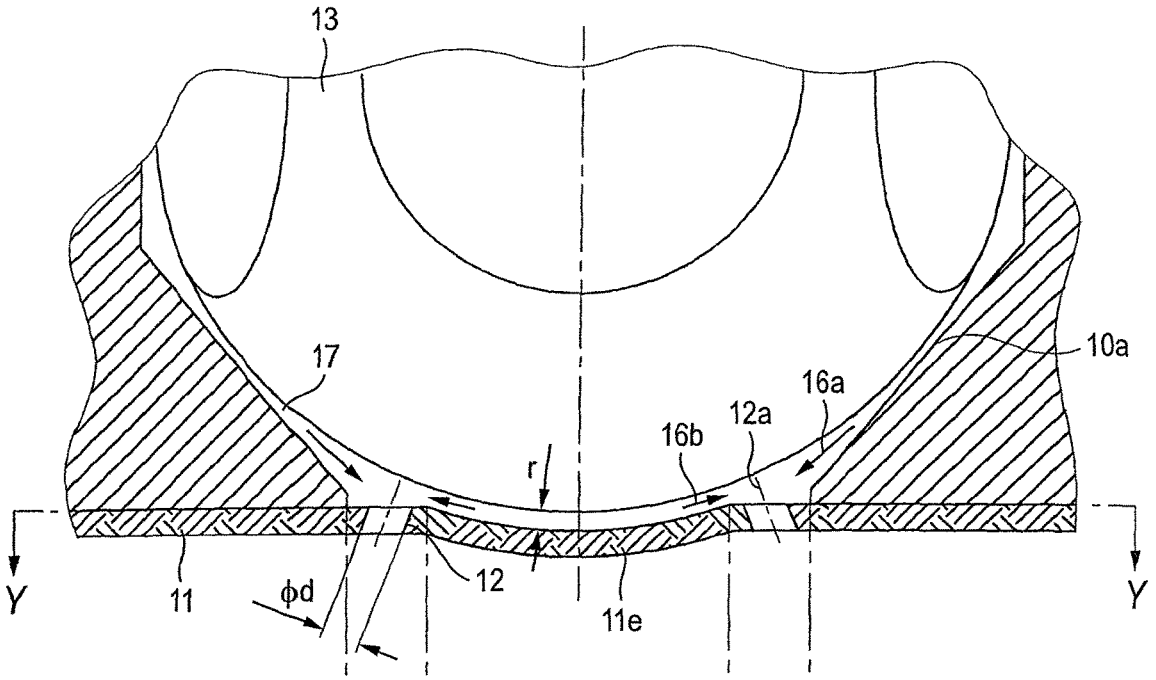
FIG. 5 is a cross-sectional view of the fuel injection valve according to a second embodiment of the present invention.
Figure 5B:
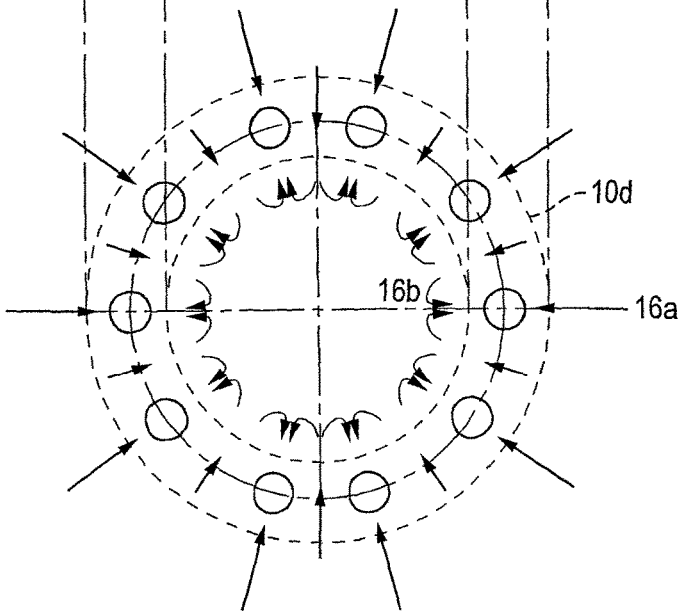

FIG. 5 is a cross-sectional view of the fuel injection valve according to a second embodiment of the present invention. In the drawing, the same reference numerals as in FIG. 1 to FIG. 4 represent the same or similar components.

As shown in FIG. 5, in the fuel injection valve in the second embodiment, a projection 11*e* which projects toward the downstream so as to extend substantially in parallel with the distal end of the valve element is formed at the center of the injection hole plate, and a flat Portion is formed outside of the projection and the relation between the minimum distance r from the distal end of the valve element to the injection hole plate with the valve opened and the diameter d of the injection hole entrance is $r<d$, and injection hole entrances are arranged inside a minimum inner diameter 10*d* of the valve seat on the flat portion.

According to the second embodiment as well, as in the first embodiment, atomization is accelerated while restraining excessive diffusion of the fuel spray and the same effect as the first embodiment can be obtained.

Third Embodiment

Figure 6A:
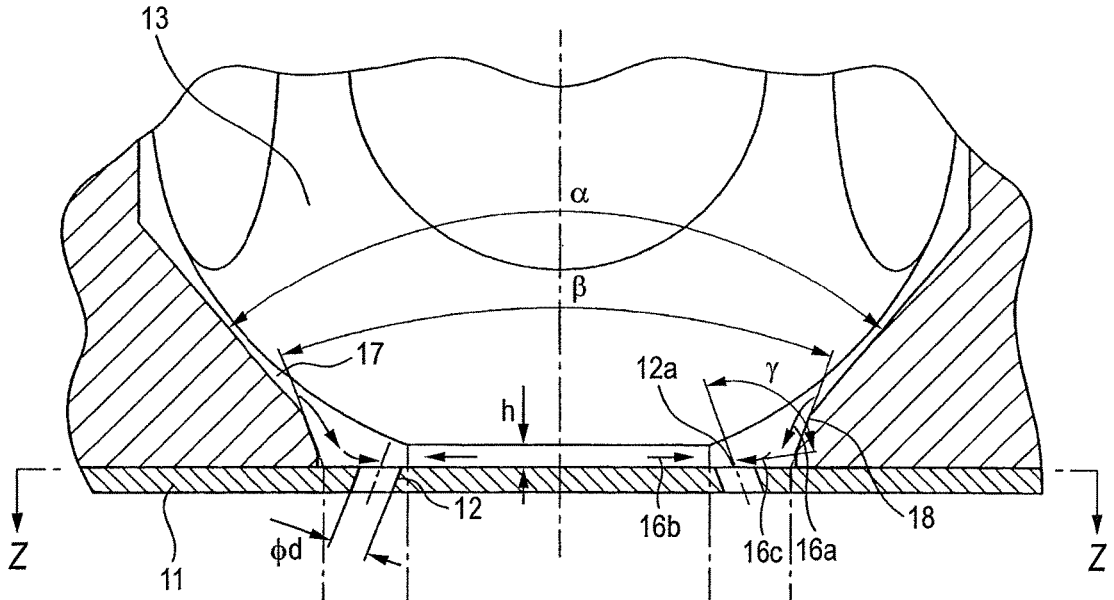
FIG. 6 is a cross-sectional view of the fuel injection valve according to a third embodiment of the present invention.
Figure 6B:
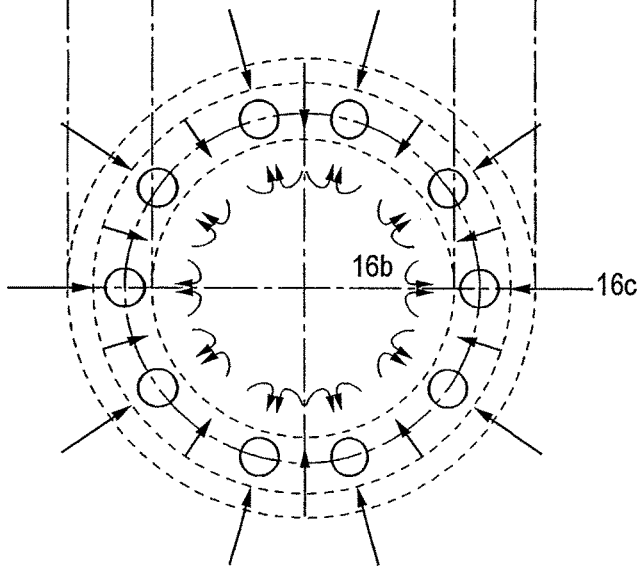

FIG. 6 is a cross-sectional view of the fuel injection valve in a third embodiment of the present invention.

As shown in FIG. 6, in the fuel injection valve according to the third embodiment, a tapered plane 18 having the valve included angle $\beta$ is provided on the downstream side of the seat surface, and when the valve included angle of the seat portion of the valve seat is represented by $\alpha$, a relation of $\alpha>\beta$ is established.

Other configurations are the same as those in the first embodiment and description will be omitted.

According to the third embodiment, the main flow 16*a* of fuel flow toward the injection hole plate 11 is guided toward, and caused to collide with, the outer periphery with respect to the injection hole entrances 12*a*, so that the flow 16*a* can be converted to a flow 16*c* along the injection plate, and the entrance angle $\gamma$ into the injection hole entrances 12*a* is increased. Therefore, separation of flow at the injection hole entrances is further enhanced, and the thickness of the liquid films is reduced, so that atomization of fuel spray is effectively accelerated.

The third embodiment is also applicable to the fuel injection valve in the second embodiment as well as the first embodiment, as a matter of course.

Fourth Embodiment

Figure 7:
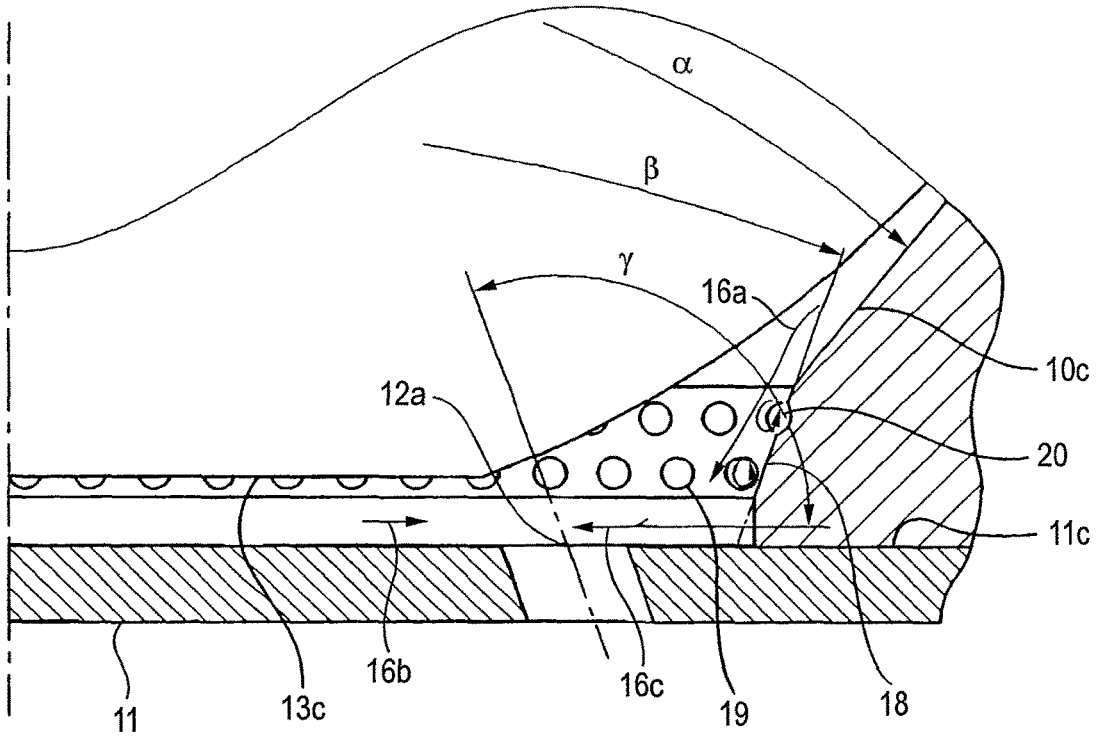
FIG. 7 is a cross-sectional view of the fuel injection valve according to a fourth embodiment of the present invention.

FIG. 7 is a cross-sectional view of the fuel injection valve according to a fourth embodiment of the present invention.

As shown in FIG. 7, in the fuel injection valve in the fourth embodiment, a plurality of dimples 19 are provided on the tapered plane 18 forming the valve included angle $\beta$ with respect to the seat angle $\alpha$ so that the relation $\alpha>\beta$ is satisfied and being provided on the downstream side of the seat surface of the valve seat.

Other configurations are the same as those in the first embodiment, and description is omitted.

According to the fourth embodiment, since a small eddy current 20 is generated on the tapered plane 18, and the fuel flow passed through the seat surface 10*c* of the valve seat by the eddy current can hardly be separated on the tapered plane 18, the main flow 16*a* of the fuel flow can be further guided toward the taper surface. Consequently, collision with the injection hole plate 11 can be guided further to the side of the outer periphery with respect to the injection hole entrances 12*a*, and the fuel flow which flows into the injection hole entrances 12*a* is converted into a flow which is parallel to the injection hole plate 11, whereby the entrance angle $\gamma$ to the injection hole entrances 12*a* may be further increased, so that atomization of fuel spray is enhanced.

The fourth embodiment is also applicable to the fuel injection valve in the second embodiment as well as the first embodiment, as a matter of course.

Fifth Embodiment

Figure 8:
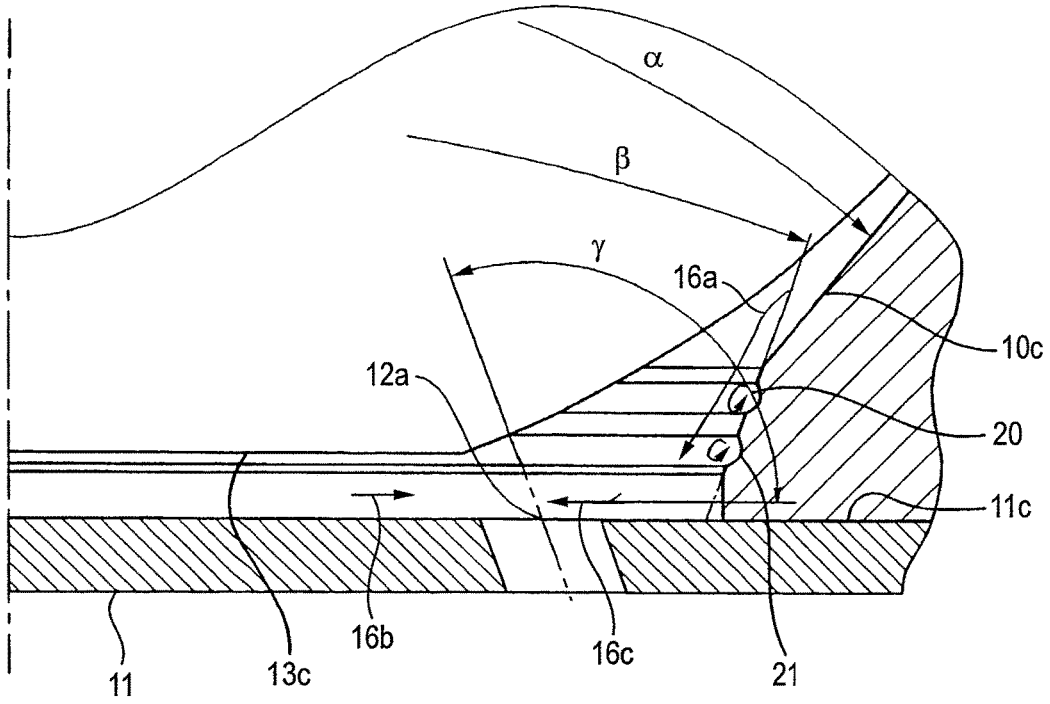
FIG. 8 is a cross-sectional view of the fuel injection valve according to a firth embodiment of the present invention.

FIG. 8 is a cross-sectional view of the fuel injection valve according to a fifth embodiment of the present invention.

As shown in FIG. 8, the fuel injection valve in the fifth embodiment is provided with a plurality of grooves 21 on the tapered plane 18 instead of the dimples in the above-described fourth embodiment, and the same effect as the fourth embodiment can be obtained.

The invention claimed is:

1. A fuel injection valve comprising a valve element for opening and closing a valve seat, the valve element being driven upon reception of an operation signal from a control unit and causing fuel to be injected from a plurality of injection holes formed on an injection hole plate having a projection formed thereon, the injection hole plate mounted on a downstream side of the valve seat, wherein said projection which projects away from the downstream side of the valve seat so as to extend substantially in parallel with a distal end of the valve element is formed at a center of the injection hole plate, and a flat portion is formed outside of the projection, wherein the relation between the minimum distance r from the distal end of the valve element to the center of the projection of the injection hole plate with the valve opened and the diameter d of an injection hole entrance is $r<d$, wherein the injection hole entrance of each of the injection holes are arranged on the flat portion of the injection hole plate and inside a minimum inner diameter of the valve seat, and wherein a periphery of the projection creates a virtual circle on the injection hole plate and the injection hole entrance of each of the injection holes is provided on the injection hole plate outside of the virtual circle;

wherein the plurality of injection holes are located along the injection hole plate in a width direction, and wherein an inner wall of a seat portion of the valve seat had a linear angled edge which is angled from an upstream point to a downstream point with respect to a thickness direction of the flat portion of the injection hole plate such that the linear angled edge extends in an oblique direction with respect to the thickness direction of the flat portion of the injection hole plate and the width direction of the injection hole plate, and the downstream point of the linear angled edge is joined to the injection plate at a connection location, and wherein the connection location is located exterior to the plurality of injection holes in the width direction of the injection hole plate.

2. The fuel injection valve according to claim 1, wherein a tapered plane having an angle $\beta$ across the valve element is provided on a downstream side of a seat surface of a seat portion of the valve seat, and when an angle of the seat portion of the valve seat across the valve element is represented by $\alpha$, a relation of $\alpha>\beta$ is established, the tapered plane having a greater incline than the seat surface.

3. The fuel injection valve according to claim 2, wherein a plurality of dimples are provided on the tapered plane.

4. The fuel injection valve according to claim 2, wherein a plurality of annular grooves are formed on the tapered plane.

5. The fuel injection valve according to claim 1, wherein, starting from a downstream position and extending to an upstream position, the linear angled edge is angled away from the plurality on injection holes in the width direction of the injection hole plate.

6. The fuel injection valve according to claim 1, wherein no portion of the linear angled edge is located interior to the plurality of injection holes in the width direction of the injection hole plate.

7. The fuel injection valve according to claim 1, wherein the thickness direction of the flat portion of the injection hole is perpendicular to the width direction of the injection hole plate.

* * * * *